United States Patent [19]

Enjo et al.

[11] Patent Number: 4,664,846

[45] Date of Patent: May 12, 1987

[54] NON-ELECTRIFICATION POLYMERIC COMPOSITE MATERIAL

[75] Inventors: Naonori Enjo, Osaka; Toshiharu Yagi, Hyogo; Masato Kagami, Fukuoka, all of Japan

[73] Assignee: 501 Daikin Industries, Ltd., Osaka, Japan

[21] Appl. No.: 760,506

[22] Filed: Jul. 30, 1985

[30] Foreign Application Priority Data

Jul. 30, 1984 [JP] Japan ..... 59-160380

[51] Int. Cl.[4] ..... H01B 1/06

[52] U.S. Cl. ..... 252/511; 428/327; 524/495; 524/496

[58] Field of Search ..... 428/327; 252/511; 523/137; 524/495, 496; 525/330.7

[56] References Cited

U.S. PATENT DOCUMENTS 4,395,362 7/1983 Satoh et al. ..... 252/511

OTHER PUBLICATIONS

Yamamoto et al., "Electrostatic Preventing Type Containing Jig"; Abstract (12,3,83).

*Primary Examiner*—Theodore E. Pertilla

*Attorney, Agent, or Firm*—Wenderoth, Lind & Ponack

[57] ABSTRACT

A non-electrification polymeric composite material composed of 60–95% by weight of a copolymer of perfluoro(alkyl vinyl ether) and tetrafluoroethylene (PFA), 1–10% by weight of electrically conductive carbon, and 5–20% by weight of carbonaceous fiber powder. The weight ratio of the electrically conductive carbon contained in the polymeric composite material to the carbonaceous fiber powder also contained in the material in from 1/9 to 7/4, preferably from 2/8 to 5/5. The polymeric composite material is especially suitable as a semiconductor holder, particularly for semiconductor wafers.

6 Claims, 1 Drawing Figure

Figure
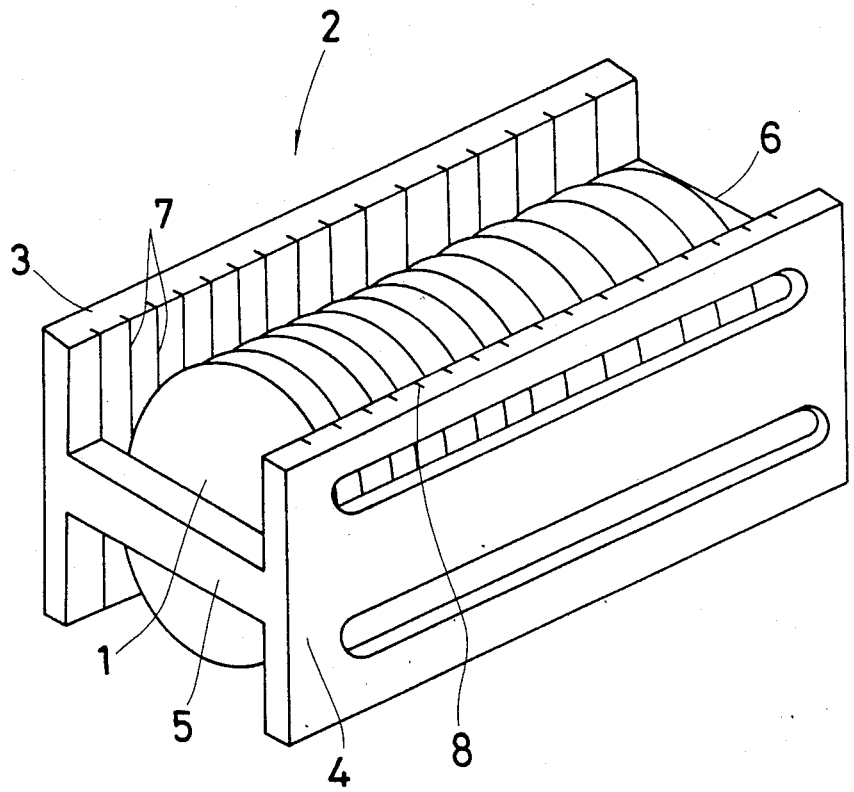

NON-ELECTRIFICATION POLYMERIC COMPOSITE MATERIAL

BACKGROUND OF THE INVENTION

1. Field of the Invention

The present invention relates to a non-electrification polymeric composite material, more particularly to a non-electrification polymeric composite material capable of being suitably employed to hold a semiconductor substrate.

2. Description of the Prior Art

In producing a semiconductor device, there has been generally taken a series of such steps as etching a semiconductor wafer, washing the wafer, and the like, with the semiconductor wafer being held by a holder, or the like. Heretofore, as a material of this holder for holding the semiconductor wafer, has been used a chemically resistant and heat-resisting fluoro resin such as polytetrafluoroethylene (referred to as PTFE), a copolymer of perfluoro(alkyl vinyl ether) and tetrafluoroethylene (referred to as PFA), or the like. Each of such polytetrafluoroethylene (PTFE) and copolymer of perfluoro(alkyl vinyl ether) and tetrafluoroethylene (PFA) is excellent in electric insulation and has as high an electric resistivity as $10^{18}$–$10^{19}$ Ω.cm at room temperature, and hence are apt to be readily electrified due to friction. Accordingly, in the case where the holder made of such fluoro resin material is dried by utilization of the centrifugal force and when rotated at a high speed, the holder is charged with static electricity due to friction between this holder and air. Consequently, the adjacent dust, dirt or the like is attracted to the thus electrified holder and then sticks to the surface of the semiconductor wafer, thereby resulting in decrease in yield of semiconductor chips.

One technique that overcomes the foregoing problem is described in Japanese Patent Application No. Tokukaisho 58-207651. This prior art discloses that mixing an electric conductor such as carbonaceous fiber, carbon black, or the like with a fluoro resin such as a copolymer of tetrafluoroethylene and perfluoro(alkyl vinyl ether) (PFA) produces a composite material which does not lose its chemical and heat resistance in respect to the fluoro resin contained therein and at the same time exhibits non-electrification characteristic per se. However, this prior art does not suggest, for example, any particular ratio of the carbonaceous fiber mixed with the copolymer of tetrafluoroethylene and perfluoro(alkyl vinyl ether) (PFA) to this copolymer. When, for example, carbon is added to the fluoro resin to make up a composite material, indiscreetly based on the disclosure of this prior art, the mechanical strength of the fluoro resin is affected by the so added carbon and further the melt viscosity of the resin is enhanced. In consequence, it becomes difficult to treat the composite material injection molding, owing to the higher melt viscosity thereof. In the etching process, furthermore, the carbon contained in the composite material is etched off into the etching solution, thereby presenting such a problem that the semiconductor wafer is soiled by the thus dropped carbon. Accordingly, the material merely deprived of its frictional electrification properties still does not sufficiently serve as the material of the holder employed for the production of the semiconductor device to hold the semiconductor wafer.

SUMMARY OF THE INVENTION

With a view to solving the foregoing problems, a primary object of the present invention is to provide a novel and improved non-electrification polymeric composite material.

A further object of the invention is to provide a non-electrification polymeric composite material which does not lose its chemical and heat resistance in respect to the polymeric material contained therein and at the same time has a nonelectrification characteristics.

In order to accomplish the above objects, a nonelectrification polymeric composite material according to the invention comprises 60–95% by weight of a polymeric material, 1–10% by weight of electrically conductive carbon, and 5–20% by weight of carbonaceous fiber powder.

In a preferred embodiment, said polymeric material is a homopolymer of tetrafluoroethylene.

In another preferred embodiment, said polymeric material is a copolymer of tetrafluoroethylene and another copolymerizable monomer.

In still another preferred embodiment, said copolymer is a copolymer of tetrafluoroethylene and one copolymerizable monomer selected from the group consisting of hexafluoropropylene, ethylene, vinylidene fluoride, trifluoroethylene, and perfluoro(alkyl vinyl ether).

In a further preferred embodiment, the weight ratio of said electrically conductive carbon to said carbonaceous fiber powder is from 1/9 to 7/4.

In a still further preferred embodiment, the weight ratio of said electrically conductive carbon to said carbonaceous fiber powder is from 2/8 to 5/5.

In a yet further preferred embodiment, said carbonaceous fiber powder is formed of particles each having a diameter of 3–30 μm and an average length of 10–10,000 μm.

According to the invention, by mixing 1–10% by weight of electrically conductive carbon and 5–20% by weight of carbonaceous fiber powder with 60–95% by weight of a polymeric material, and determining the weight ratio of the electrically conductive carbon to the carbonaceous fiber powder to be from 1/9 to 7/4, particularly from 2/8 to 5/5, there is prepared a non-electrification composite material which does not lose such characteristics as the chemical and heat resistance for the polymeric material contained therein and whose carbon component is remarkably prevented from dropping off from the composite material to as great an extent as possible, thereby to achieve an excellent moldability.

BRIEF DESCRIPTION OF THE DRAWING

Other features and advantages of the invention will be apparent from the following description taken in connection with the accompanying drawing wherein:

The FIGURE in the drawing is a perspective view showing an embodiment of a holder, for holding a semiconductor wafer, made of a non-electrification polymeric composite material according to the invention.

DETAILED DESCRIPTION OF THE PREFERRED EMBODIMENTS

Now referring to the drawing, preferred embodiments of the invention are described below.

The FIGURE in the drawing is a perspective view illustrating an embodiment of a holder 2 made of a non-electrification polymeric composite material according to the invention. This holder 2 which holds a plurality of semiconductor wafers 1 is in the shape of the letter H in the section perpendicular to its axial line, and comprises a pair of walls 3,4 facing each other for holding the peripheral edges of the semi-conductor wafers 1 and a pair of connecting portions 5 and 6 for connecting the walls 3 and 4. In the walls 3 and 4, there are formed a pair of sets of grooves 7 and 8, in which the semiconductor wafers 1 are respectively fitted. As a material of the holder 2, is used the non-electrification polymeric composite material according to the invention. A series of such steps as etching, washing, and drying the semiconductor wafers 1 is taken, with the wafers 1 being held by the holder 2.

As the polymeric material to be employed in the invention, a homopolymer of tetrafluoroethylene or a copolymer of tetrafluoroethylene and another copolymerizable monomer is preferred. Such a copolymer includes a copolymer of tetrafluoroethylene and one copolymerizable monomer selected from the group consisting of hexafluoropropylene, ethylene, vinylidene fluoride, trifluoroethylene, and perfluoro(alkyl vinyl ether). The copolymer of tetrafluoroethylene and perfluoro(alkyl vinyl ether) (referred to as PFA) is particularly preferable as this copolymer. As the electrically conductive carbon to be mixed with the polymeric material there is preferred an organic material having a high electric conductivity, for example, carbon black. As the carbonaceous fiber powder to be likewise mixed with the polymeric material, there is preferred one which is formed of finely powdered carbonaceous fiber whose each particle has a diameter of approximately 3–30 μm and an average length of approximately 10–10,000 μm.

It is preferred that the amount of the electrically conductive carbon contained in the non-electrification polymeric composite material be determined within the range of from 1 to 10% by weight based on the total weight of the composite material, while it is preferred that the amount of carbonaceous fiber powder contained in the composite material be determined within the range of from 5 to 20% by weight based on the total weight of the composite material. When the content of the electrically conductive carbon is more than 10% by weight, the strength of the polymeric material is affected by electrically conductive carbon mixed therewith in such amount and further the melt viscosity of the material is enhanced. Hence it becomes difficult to subject the composite material to injection molding owing to its higher melt viscosity. On the contrary, when the content of the electrically conductive carbon is less than 1% by weight, the composite material is observed to remarkably exhibit frictional electrification characteristics. In the meantime, when the content of the carbonaceous fiber powder is more than 20% by weight, the carbon contained in the composite material drops off and is dissolved in the etching solution during the etching process of etching the semiconductor wafer, thus leading to soiling of the wafer. In contrast, when the content of the carbonaceous fiber powder is less than 5% by weight, the processability of the composite material is deteriorated.

Furthermore, it is preferred that the weight ratio of the electrically conductive carbon to the carbonaceous fiber powder be from 1/9 to 7/4, particularly from 2/8 to 5/5. When the weight ratio of the electrically conductive carbon to the carbonaceous fiber powder is below 1/9, the composite material is observed to remarkably exhibit frictional elecrification characteristics. On the contrary, when the weight ratio of the electrically conductive carbon to the carbonaceous fiber powder is above 7/4, the processability of the composite material is deteriorated. Meanwhile, when the weight ratio of the electrically conductive carbon to the carbonaceous fiber powder is from 2/8 to 5/5, the composite material substantially loses the frictional electrification property and obtains the excellent processability.

Accordingly, in view of the foregoing, the contents of the respective components to make up the non-electrification polymeric composite material acording to the invention are to be determined as defined above.

The invention will be explained in more detail by the following examples.

EXAMPLES 1–3

A total of 10 parts by weight of (a) electrically conductive carbon, Ketjen black EC (trade name, manufactured by Lion-Agnes Co.) and (b) carbonaceous fiber powder, BESFIGHT HTA 3000 (trade name, manufactured by Toho Rayon Co., Ltd.) in the various weight ratios as shown in Table 1 below were mixed with 90 parts by weight of a copolymer of tetrafluoroethylene and perfluoro(alkyl vinyl ether) (PFA), Neoflon PFAAP-210 (trade name, manufactured by Daikin Industries, Ltd.) which is excellent in injection-moldability, by means of a kneader heated at 350° C., for approximately 5–20 minutes to obtain polymeric composite materials. The thus obtained polymeric composite materials were then heat-pressed at 350° C. to be molded into sheet-shaped samples each having a thickness of 1 mm. Thereafter the samples thus molded were subjected to tests of the frictional electrification properties, the degree of the dropping-off of the carbon, and the processability.

The results are shown in Table 1.

TABLE 1

| Example No. | Electrically Conductive Carbon/ Carbonaceous Fiber Powder (weight ratio) | Frictional Electrification Property | Degree of Dropping-off of Carbon | Processability |
|---|---|---|---|---|
| 1 | 2/8 | A,~B,~C | D~E | G |
| 2 | 3.5/6.5 | C | E~D | G |
| 3 | 5/5 | C | E~D | I |

The procedures of these tests and the methods of illustrating the results are as follows.

Test of Frictional Electrification

The sample which were composed of the copolymers of tetrafluoroethylene and perfluoro(alkyl vinyl ether) (PFA), and electrically conductive carbon and carbonaceous fiber powder both mixed with the copolymers in such weight ratios as shown in Table 1 were rubbed with nylon or cloth so as to be electrified. Then, attempts were made to attach a sheet of thick typing paper having a size of 2×2 cm with the thus electrified samples.

The results of such attemps are shown by the following symbols A, B, and C in Table 1:

Figure
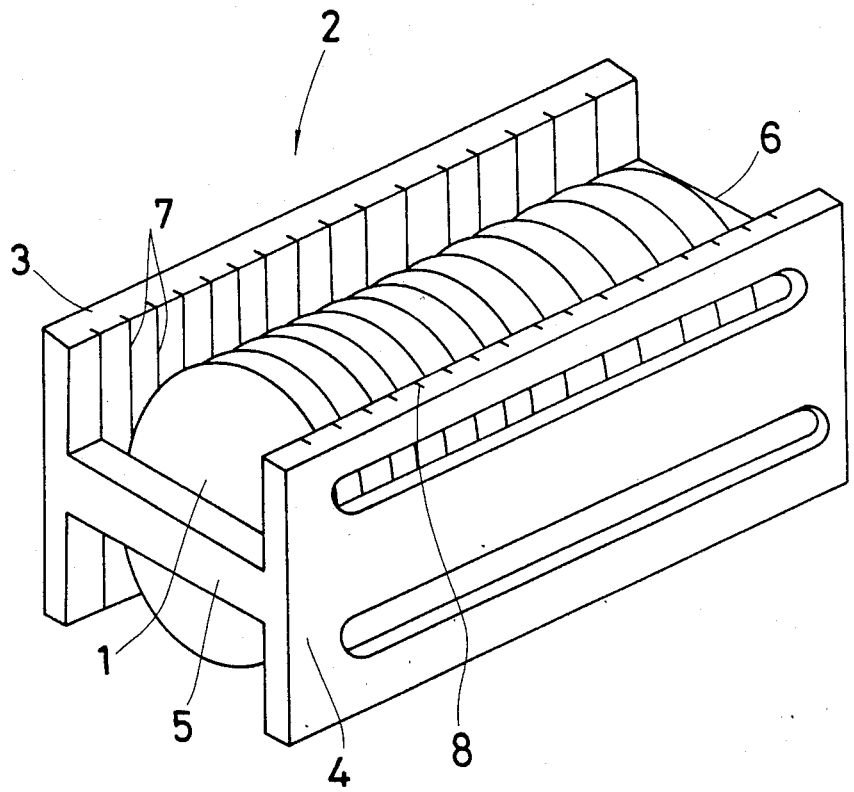

A: the sheet of typing paper was attached with the samples.